US008453596B2

(12) United States Patent
Luebbecke et al.

(10) Patent No.: US 8,453,596 B2
(45) Date of Patent: Jun. 4, 2013

(54) APPARATUS FOR APPLYING FLUIDS

(75) Inventors: Kai Luebbecke, Wittorf (DE); Thomas Burmester, Bleckede (DE); Hubert Kufner, Lueneburg (DE)

(73) Assignee: Nordson Corporation, Westlake, OH (US)

( * ) Notice: Subject to any disclaimer, the term of this patent is extended or adjusted under 35 U.S.C. 154(b) by 860 days.

(21) Appl. No.: 12/556,807

(22) Filed: Sep. 10, 2009

(65) Prior Publication Data

US 2010/0064967 A1 Mar. 18, 2010

(51) Int. Cl.

| | |
|---|---|
| ***B05B 7/00*** | (2006.01) |
| ***B05B 7/06*** | (2006.01) |
| ***B05B 13/02*** | (2006.01) |
| ***B05C 5/00*** | (2006.01) |
| ***B05C 15/00*** | (2006.01) |
| *B05C 3/02* | (2006.01) |
| *B05C 11/04* | (2006.01) |
| *B05B 1/14* | (2006.01) |
| *B05B 1/20* | (2006.01) |

(52) U.S. Cl.
USPC ..... 118/300; 118/314; 118/325; 118/411; 156/578; 239/562; 239/566

(58) Field of Classification Search
USPC ..... 118/300, 314, 325, 411; 239/566, 239/562, 556, 568; 156/578
See application file for complete search history.

(56) References Cited

U.S. PATENT DOCUMENTS

| | | | | |
|---|---|---|---|---|
| 2,827,928 | A * | 3/1958 | Guckel | 222/553 |
| 3,182,867 | A | 5/1965 | Barosko et al. | |
| 4,451,414 | A | 5/1984 | Rossiter | |
| 4,510,784 | A * | 4/1985 | Hsu | 239/563 |
| 4,628,961 | A | 12/1986 | Lew | |
| 4,667,879 | A * | 5/1987 | Muller | 239/133 |
| 6,464,785 | B1 * | 10/2002 | Puffe | 118/301 |
| 2006/0016391 | A1 | 1/2006 | Puffe | |

FOREIGN PATENT DOCUMENTS

| | | | |
|---|---|---|---|
| DE | 2409544 | A1 | 9/1974 |
| DE | 19854634 | C1 | 2/2000 |
| DE | 19915390 | A1 * | 10/2000 |
| DE | 10306884 | B3 | 6/2004 |
| EP | 1666163 | A2 | 6/2006 |
| JP | 05084458 | | 4/1993 |
| JP | 09327645 | | 12/1997 |

OTHER PUBLICATIONS

European Patent Office, European Search Report in EP 09168183, Oct. 5, 2009.

* cited by examiner

*Primary Examiner* — Dah-Wei Yuan
*Assistant Examiner* — Binu Thomas
(74) *Attorney, Agent, or Firm* — Wood, Herron & Evans, L.L.P.

(57) ABSTRACT

An apparatus for applying fluids such as adhesive, in particular hot melt adhesive, to a substrate movable relative to the apparatus, comprising a main body having a feed passage connectable to a fluid source, an application valve for selectively interrupting or enabling the flow of fluid in the feed passage, and a nozzle arrangement having a distributor passage connectable to the feed passage and at least one nozzle opening communicating with the distributor passage for delivery of the fluid. A body is movable in the distributor passage and has through passages which can be selectively associated with the nozzle opening by means of movement of the body in such a way that fluid is passed out of the distributor passage into the nozzle opening through at least one through passage.

15 Claims, 5 Drawing Sheets

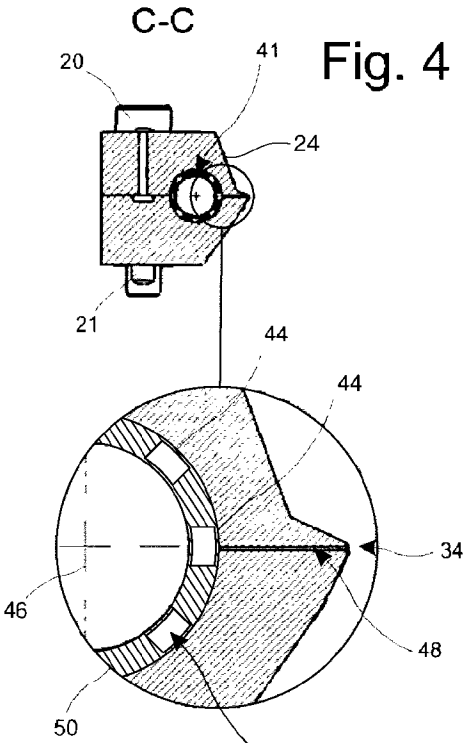
Fig. 4
Fig. 5
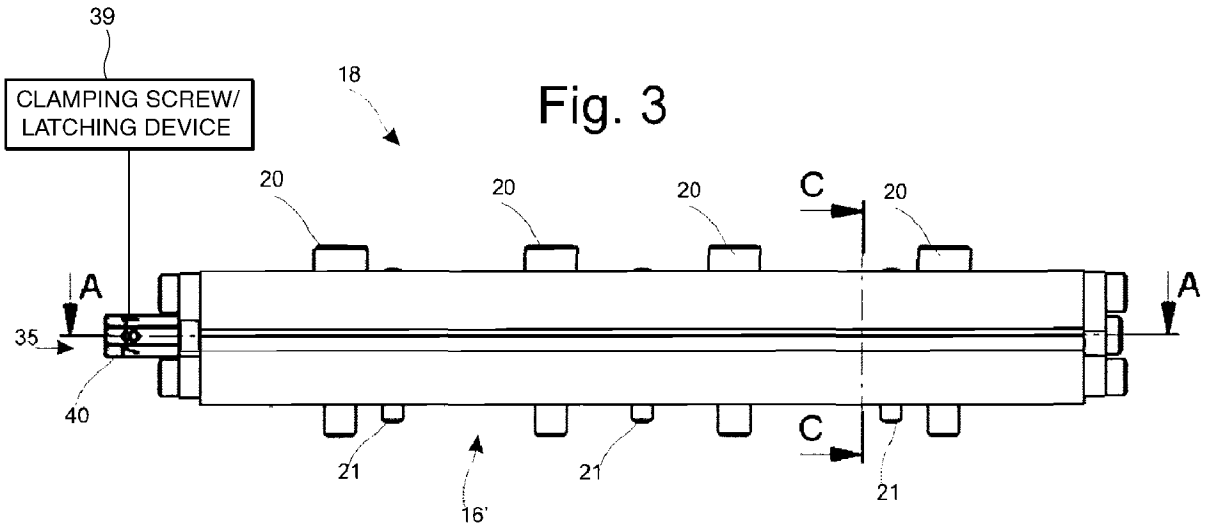
Fig. 3
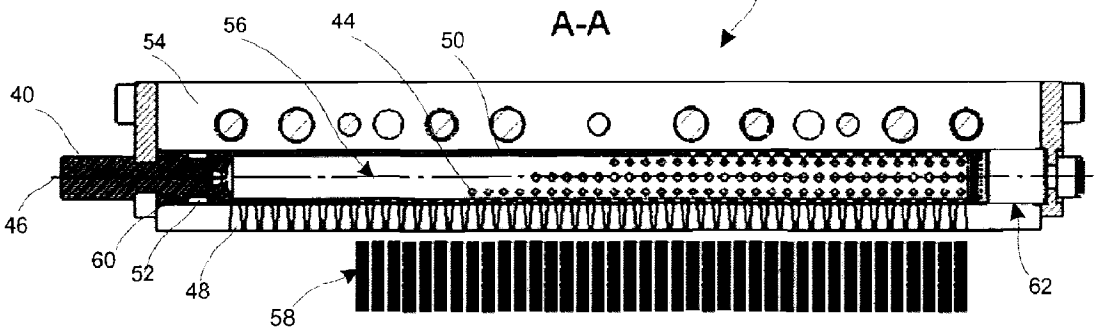
Fig. 6

APPARATUS FOR APPLYING FLUIDS

The present application claims the priority benefit of German Patent Application No. 10 2008 047 266.2, filed Sep. 12, 2008, the disclosure of which is hereby incorporated by reference herein.

TECHNICAL FIELD

The present invention concerns an apparatus for applying fluids such as adhesive, in particular hot melt adhesive, to a substrate movable relative to the apparatus.

BACKGROUND

Apparatus for applying thermoplastic fluids are frequently also referred to as application heads and are used, for example, when substrates in film form or layer form are to be coated with fluid adhesive, for example, hot melt adhesive, over a surface area thereof or in beads in order to produce given application patterns, for example, shapes of the applied fluid. The fluid adhesive is usually stored in a fluid source such as a melting device. That fluid source is communicated with a main body of the apparatus by way of a hose connection. The fluid adhesive is conveyed by means of a conveyor means such as for example a pump into the apparatus and further conveyed through a distributor passage and in so doing passes a valve body of an application valve. The distributor passage communicates with a nozzle opening from which the adhesive is delivered and applied to a substrate. As the substrate is movable relative to the apparatus the fluid is applied to the substrate over the surface thereof. In known apparatus of that kind the nozzle opening is typically in the form of an elongate slot. The length of the operative portion of the slot can be adjusted by a piston arranged movably in the longitudinal direction in the distributor passage. Such an apparatus is known, for example, from DE 299 08 150. Apparatus are also known with which adhesive beads or strips can be applied.

Some problems arise in operation of the known applicator apparatus. Adjustment of the width of the area of the fluid to be applied is effected by a pushing or pulling movement of a piston in the distributor passage. While a pushing movement involves fluid being urged out of the nozzle arrangement in addition to the desired application thereof, air is sucked into the nozzle arrangement when the piston is performing a pulling movement. It is to be noted that when there is air in the nozzle the nozzle has to be vented before it can be brought into operation again. It is essentially a change in volume in the interior of the distributor passage that is responsible for that adverse effect. A further disadvantage is that applicators of the above-described kind occupy a comparatively large amount of space as, in addition to the space required by the apparatus itself, there must also be sufficient space at one side of the apparatus in order to be able to accommodate the piston in the condition of maximum extension thereof. That makes it difficult, inter alia, to arrange a plurality of applicators apparatus in a row with each other at a small spacing in mutually juxtaposed relationship. In the industrial production of substrates to which a fluid is applied, that has the effect of increased manufacturing costs.

Consequently, an object of the invention is to provide an apparatus which, as substantially as possible, alleviates the disadvantages found in the state of the art and with which various application patterns can be produced in a simple fashion.

SUMMARY

In one illustrative embodiment, a body is movable in a distributor passage and has through passages which can be selectively associated with the nozzle opening by means of movement of the body in such a way that fluid is passed out of the distributor passage into the nozzle opening through at least one through passage. It is thus easily possible to produce different application patterns, depending on the respective position of the movable body. The movement of the body in the distributor passage is such that a movement of the body does not result in a change in volume in the distributor passage. The kind of movement of the body in this respect may be translatory or rotational, for example, in which case the body is only moved in each case to such an extent that the through passages are just no longer aligned to the nozzle opening in such a way that a flow of fluid would be possible. The deflection of the body to go from an enablement or open position into a closed position is consequently only minimally greater than the diameter of the through passages. The result of this is that markedly less space is required to be able to accommodate and move the movable body. A body adapted for rotary movement in the distributor passage would accordingly only have to be rotated to such an extent that the opening cross-sections of the through passages just no longer coincide with the corresponding nozzle opening in such a way that a flow of fluid would be possible.

The application pattern which is produced by the apparatus and delivered to the substrate is afforded by a change in the association of through passages with the at least one nozzle opening. In that case, the volume of the distributor passage in which fluid to be delivered is disposed remains substantially constant.

That kind of movement of the body—translatory or rotational—means that no fluid is urged out of the nozzle arrangement or no air is sucked into the nozzle arrangement as the volume of the body in the distributor passage remains constant. Only the position of the openings is changed by the movement of the body.

In an advantageous embodiment the body is a hollow body which is rotatable in the distributor passage and has radially arranged through passages which can be associated with the nozzle opening by means of rotation of the hollow body. The advantage of a rotatable hollow body in the distributor passage is in particular that it is possible to arrange on the periphery of the hollow body, a large number of different combinations of through passages which by rotation of the hollow body respectively cause a different width of application of fluid to the substrate and/or produce different application patterns. It is, however, immaterial how many different settings are provided in the hollow body for the necessary space that the applicator apparatus in accordance with this embodiment occupies.

In accordance with a further advantageous embodiment of the present invention a plurality of through passages are arranged in a row parallel to a longitudinal axis of the hollow body and extend through a peripheral surface of the hollow body. In that way, it is possible to apply, for example, beads or strips. In this case the row is advantageously arranged on the periphery of the hollow body in such a way that, by rotation of the hollow body, all through passages of that row can be simultaneously aligned with the at least one nozzle opening so that fluid can be transferred from the distributor passage to the nozzle opening.

In accordance with a further advantageous embodiment of the apparatus according to the invention a multiplicity of the rows formed by the through passages are respectively mutually spaced along the periphery of the hollow body. With such a selection for the arrangement of the through passages on the periphery of the hollow body, a respective given row of through passages can be aligned with the at least one nozzle opening by rotation of the hollow body into a respective given position.

In a further advantageous embodiment of the apparatus according to the invention the rows formed by the through passages are arranged in mutually differing relationship in the hollow body in relation to the longitudinal axis thereof. The fact that the rows are arranged in mutually differing relationship on the periphery of the hollow body in the above-described manner means that, upon rotation of the hollow body, the position can be altered in relation to the longitudinal axis of the hollow body. In relation to the substrate which is movable relative to the apparatus, that means that the application position of the fluid to the substrate is variable by simply rotating the hollow body into another position.

In accordance with a further advantageous embodiment of the apparatus according to the invention the rows of the through passages respectively have a different number of through passages and/or respectively involve a different spacing between the through passages. Such a configuration for the through passages on the hollow body makes it possible to provide a different configuration of through passages for each row of through passages and accordingly for each angular position of the hollow body. The consequence of this is that, in each angular position of the hollow body, in which a row of through passages is aligned with the at least one nozzle opening, it is possible to apply a specific application pattern linked thereto to the substrate. In that case, it is possible to switch over between different application patterns by simply rotating the hollow body.

In accordance with a further advantageous embodiment of the present invention the through passages have an opening cross-section which is circular, elliptical, oval or polygonal, in particular rectangular. The choice of different geometries for the through passages makes it possible to take optimum account of different geometries of the at least one nozzle arrangement. Furthermore it is possible to specifically and targetedly influence the flow of material and the application image or pattern by the variation in the geometries. Furthermore in accordance with the above-described embodiment it is possible for the through passages to be in the form of slots so that, with a nozzle opening of a suitable configuration, it is possible for fluid to be applied to the substrate in an uninterrupted fashion over an area thereof.

In accordance with a further embodiment of the present invention the hollow body is mounted in the distributor passage rotatably in such a way that in a respective angular position of the hollow body a through passage or a row of through passages which are arranged parallel to the longitudinal axis of the hollow body can be aligned with the at least one nozzle opening.

In accordance with a further advantageous embodiment of the apparatus according to the invention the at least one nozzle opening is provided at the outlet end of an outlet passage in the form of a recess, in particular a milled-out recess, in the nozzle arrangement, and in particular is of a slot-shaped or round cross-section, wherein the outlet passage is adapted to connect the nozzle opening in fluid-conducting relationship with the distributor passage. Milling the outlet passage out of the body of the nozzle arrangement makes it possible to produce the outlet passages with a high degree of precision and repetition accuracy. That is advantageous in particular for a uniform precise discharge of fluid.

In a further advantageous embodiment of the apparatus according to the invention the at least one outlet passage has an inlet of a width corresponding to the width of the through passage which can be associated therewith of the hollow body. Adapting the width of the outlet passage to the width of the feed passage which can be associated therewith provides that impairment of the flow of fluid at the transition between the through passage and the outlet passage is influenced or disturbed to a lesser degree than would be the case if the two passages were not matched to each other in their width.

In a further advantageous embodiment of the apparatus according to the invention the at least one outlet passage is of a polygonal, in particular rectangular or trapezoidal longitudinal cross-section. A configuration for the outlet passage, in which there is an increasing and/or decreasing passage width in the longitudinal direction of the outlet passage, can be advantageous for influencing the discharge performance of the fluid, in particular the discharge speed and the form of flow thereof. The precise configuration of the outlet passage depends on the respective individual case, in particular the fluid to be used and operating parameters such as for example viscosity, temperature and pressure.

In accordance with a further advantageous embodiment of the present invention the body can be arrested in a predetermined angular position in force-locking or positively locking relationship, in particular by means of a clamping screw or a latching means. Advantageously, such arrestability is to be provided for precisely the angular positions in which a respective row of through passages is oriented in aligned relationship with the at least one nozzle opening. Such an arresting capability prevents unintentional displacement of the hollow body, which could lead to unwanted changes in the application pattern. Clamping devices such as, for example, clamping screws are to be considered as an arresting means having a force-locking action. Various latching means appear appropriate to provide a positively locking arresting effect. They can include, for example, spring-assisted mechanisms such as resilient pressure portions.

In accordance with a further embodiment of the present invention a rotary grip is provided which is non-rotatably connected to an end portion of the body and which extends outside the nozzle arrangement. Actuation of the rotary grip makes it possible to manually adjust the desired application pattern by means of rotation of the hollow body. In addition, as an alternative to displacement of the hollow body by manual rotation of the rotary grip, it is possible to fit a motor drive for the hollow body, which either externally co-operates with the rotary grip or can be disposed within the housing of the apparatus according to the invention. The transmission of force from such a motor drive to the hollow body can be effected for example by way of a gear transmission and/or a belt drive.

In a further advantageous embodiment of the apparatus according to the invention a peripheral surface or a peripheral surface composite of the rotary grip is roughened. Roughening at least a part of the surface of the rotary grip contributes to the operator having a better hold on the rotary grip. Operability of the apparatus is decisively improved in that case. In that respect the rotary grip can be of a substantially cylindrical configuration or as a departure therefrom may be of a non-circular cross-sectional area, being for example of a polygonal or stellate cross-sectional shape.

In accordance with a further embodiment of the present invention the nozzle arrangement has a mouthpiece which is connectable to the nozzle arrangement and can be associated with a portion of the nozzle arrangement, in which the at least one outlet passage and the at least one nozzle opening are arranged. The mouthpiece is preferably connected to the nozzle arrangement by way of fastening means and is of an area which is so arranged at the nozzle arrangement that it delimits the outlet cross-section of the at least one nozzle opening. Advantageously, the mouthpiece can be connected to the nozzle arrangement in such a way that it is releasable therefrom with a few manipulation operations in order to be able to clean the at least one nozzle opening and the at least one outlet passage and/or the nozzle arrangement overall. The fact that cleaning of the nozzle arrangement can be effected without the entire apparatus having to be dismantled, but only the mouthpiece, means that the outage and maintenance times in operation of the apparatus according to the invention can be reduced.

In accordance with a further advantageous embodiment of the apparatus according to the invention the fluid is fed to the hollow body by means of a peripherally extending recess, in particular an annular groove, which is provided in the peripheral surface of the hollow body, wherein at least one conduit extends from the recess into the interior of the hollow body. A feed of fluid into the interior of the hollow body is possible in any angular position of the hollow body by means of the annular groove.

In accordance with a further advantageous embodiment of the apparatus according to the invention an outside wall of the hollow body at least in portions in which through passages extend can be brought into substantially sealing contact with a wall of the distributor passage. That ensures that fluid which has been fed to the interior of the hollow body can pass into the at least one outlet passage exclusively through the through passages. Unwanted issue of fluid from leaks or leaking locations is avoided in that way so that the risk of the apparatus being clogged and contaminated with adhesive is reduced.

BRIEF DESCRIPTION OF THE DRAWINGS

The invention is described in greater detail hereinafter by means of illustrative embodiments by way of example of the apparatus according to the invention for applying fluids such as adhesive, in particular hot melt adhesive, to a substrate movable relative to the apparatus, and with reference to the accompanying drawings in which:

FIG. 3 shows a side view from below of a nozzle arrangement, FIG. 4 shows a cross-sectional view of the nozzle arrangement of FIG. 3, FIG. 5 shows a detail view from the view of FIG. 4, FIG. 6 shows a further cross-sectional view of the nozzle arrangement of FIGS. 3 through 5.

DETAILED DESCRIPTION OF THE ILLUSTRATIVE EMBODIMENTS

Figure 1:
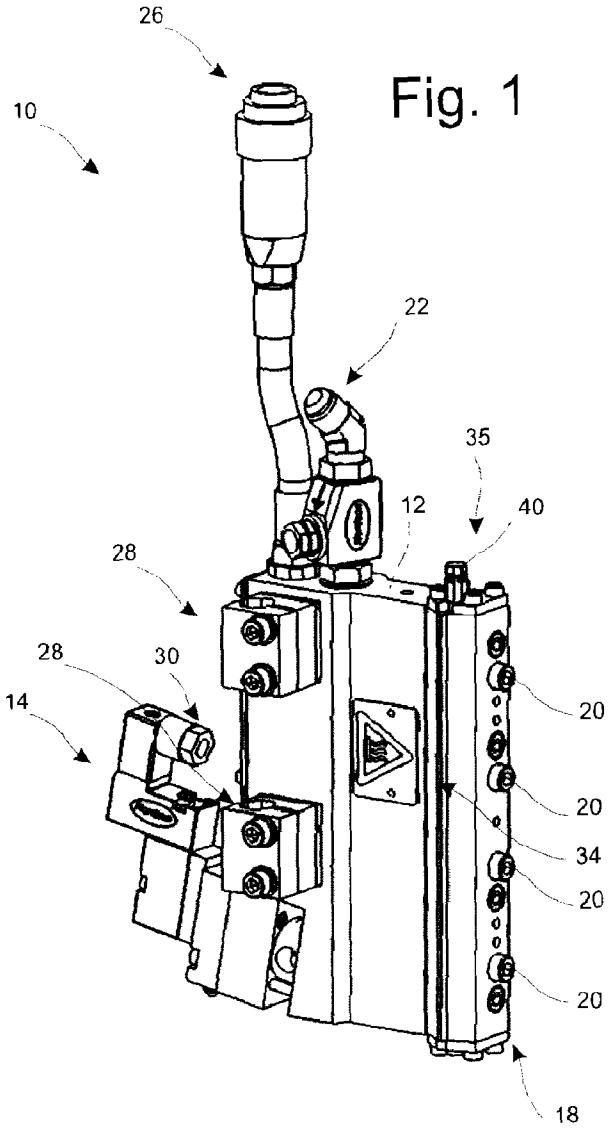
FIG. 1 shows a perspective external view of an adhesive applicator apparatus according to a first embodiment of the invention.

The apparatus 10 shown in FIG. 1 serves for applying fluids such as adhesive, in particular hot melt adhesive, to a substrate movable relative to the apparatus 10. The apparatus 10 includes an electropneumatically actuable application valve 14 connected to a main body 12. The main body 12 has an end face 13 at which the application valve 14 is arranged. In this case the end face (see FIG. 2) has an angled step 13' at which the application valve is arranged.

Figure 2:
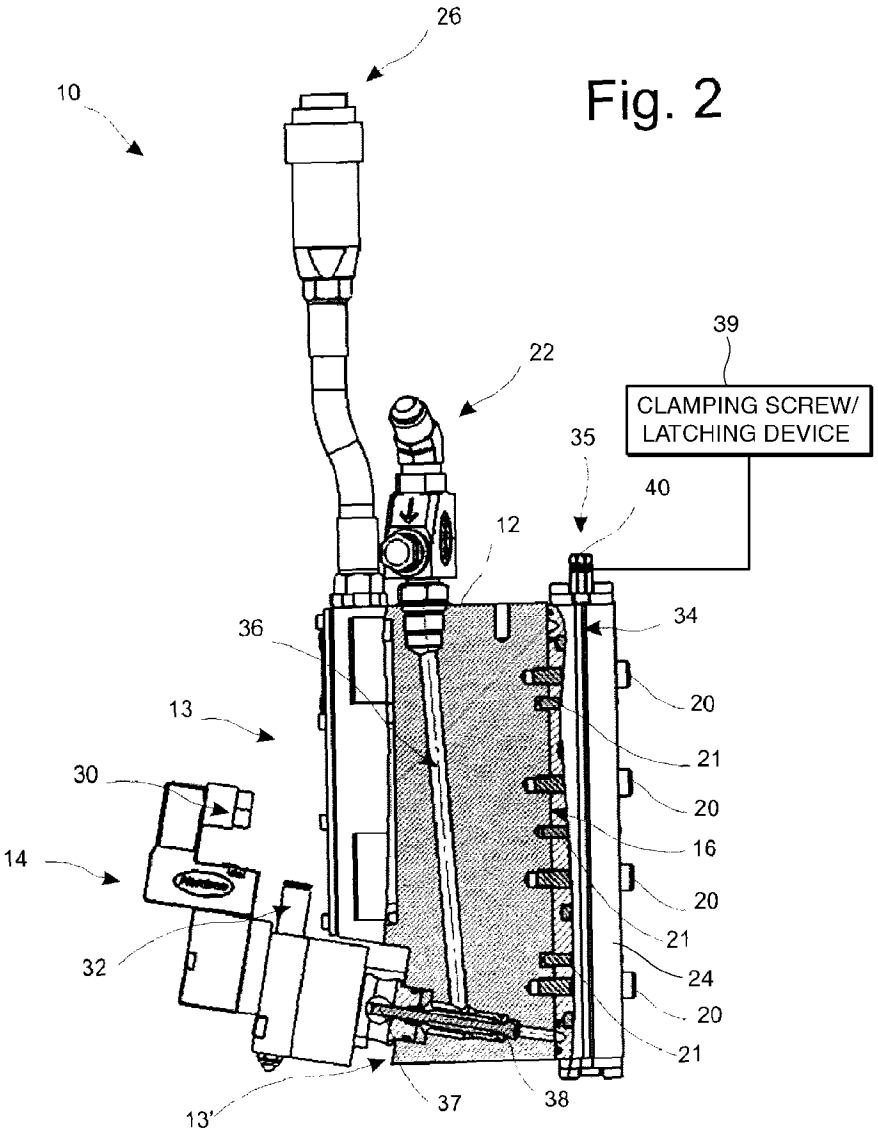
FIG. 2 shows a partly cross-sectional side view of the apparatus of FIG. 1.

A nozzle arrangement 18 is releasably fastened by means of screw connections 20 to a side 16 of the main body 12, that is opposite to the end face 13, and centered by means of pins 21 (see FIG. 2). The nozzle arrangement has a mouthpiece 24 releasably connected to the nozzle arrangement 18. The apparatus 10 can be communicated with a fluid source (not shown) by means of a hose connection 22. The apparatus 10 further has a connecting element 26, by means of which electrical power can be fed to the apparatus 10. The apparatus 10 can be fixed in a position by means of fastening elements 28.

The electrically actuable application valve 14 has an electrical connection 30 and a compressed air connection 32 shown in FIG. 2. A compressed air source (not shown) can be connected by means of the compressed air connection 32. The application valve 14 serves to selectively interrupt or enable the flow of fluid from the fluid source to the nozzle arrangement 18.

As can be seen from FIGS. 1 and 2 the nozzle arrangement 18 has a nozzle opening 34 which in the selected embodiment is of a substantially slot-shaped configuration. In addition disposed at a side 35 of the nozzle arrangement 18 is a rotary grip 40 which permits displacement of the application pattern delivered by the applicator apparatus 10, on the substrate. The path in principle of the fluid can further be seen from FIG. 2. Fluid is fed to the apparatus 10 from the fluid source through the connection 22. The fluid flows through a feed passage 36 to the nozzle arrangement 18, wherein the feed passage 36 is selectively closed or opened by a valve body 38. The valve body 38 is moved by a valve needle 37.

The nozzle arrangement 18 is shown in FIG. 3. The fastening screws 20 extend through the nozzle opening 18 and project at a side 16' out of the nozzle arrangement 18 to come into engagement with screwthreads (not shown) in the main body 12. The pins 21 extend partially within the nozzle arrangement 18 and also project out of the opening 16' from the housing of the nozzle arrangement 18. The rotary grip 40 is arranged at the side 35 of the nozzle arrangement and is actuable by a hand of an operator.

The cross-sectional view in FIG. 4 corresponds to a section through the nozzle arrangement of FIG. 3 along line C-C. A distributor passage 41 is disposed within the nozzle arrangement 18. The distributor passage 41 is substantially cylindrical and extends along a longitudinal axis 46 shown in the detail view in FIG. 5 and FIG. 6.

As can further be seen from FIG. 5 a movable body in the form of a hollow body 50 is mounted rotatably within the distributor passage 41. The hollow body 50 has a multiplicity of through passages 44 arranged along the outer periphery 51 of the hollow body 50 (see FIGS. 9 and 10). It can further be seen that the nozzle opening 34 is in fluid-conducting communicating relationship by means of at least one outlet passage 48, which directly communicates with at least one through passage 44 as it is aligned with the nozzle opening 34 by means of rotation of the hollow body 50. The hollow body 50 is mounted rotatably about the longitudinal axis 46 of the distributor passage 41.

It will be seen from FIG. 6 which is a cross-sectional view of the nozzle arrangement of FIG. 3 along line A-A that fluid is fed to the hollow body 50 by means of a conduit 54. The fluid passes from the conduit 54 into an annular groove 52 arranged extending around the hollow body 50 and from which it passes from further conduits 55 (see FIG. 7) into the interior 56 of the hollow body 50. As is further clearly shown in FIG. 6 the hollow body 50 has a plurality of rows of through passages 44 which are respectively arranged parallel to the longitudinal axis 46 on the periphery of the hollow body 50, the rows being respectively arranged in spaced relationship along the periphery of the hollow body 50. In that way, by rotary movement of the hollow body 50 at the rotary grip 40, a respective row with through passages 44 can be so associated in the distributor passage 41 that the through passages 44 are in aligned and fluid-conducting communicating relationship with the outlet passages 48. When the outlet passages are aligned with through passages 44 as shown in FIG. 6, fluid can be discharged from the apparatus 10 on to a substrate. That affords an application pattern 58.

The hollow body 50 is arranged within the distributor passage 41 in such a way that the hollow body 50 is in sealing contact with a wall 62 of the distributor portion 41 at least partially in portions in which through passages extend. That prevents fluid from issuing. In addition a sealing element 60 is arranged in a groove at the periphery of the hollow body 50, which prevents fluid from escaping from the housing from the side 35. The hollow body 50 can be arrested in a predetermined angular position in force-locking or positively locking relationship, in particular by a clamping screw or a latching device 39. Such an arresting capability prevents unintentional displacement of the hollow body 50, which could lead to unwanted changes in the application pattern 58.

Figures 7, 8:
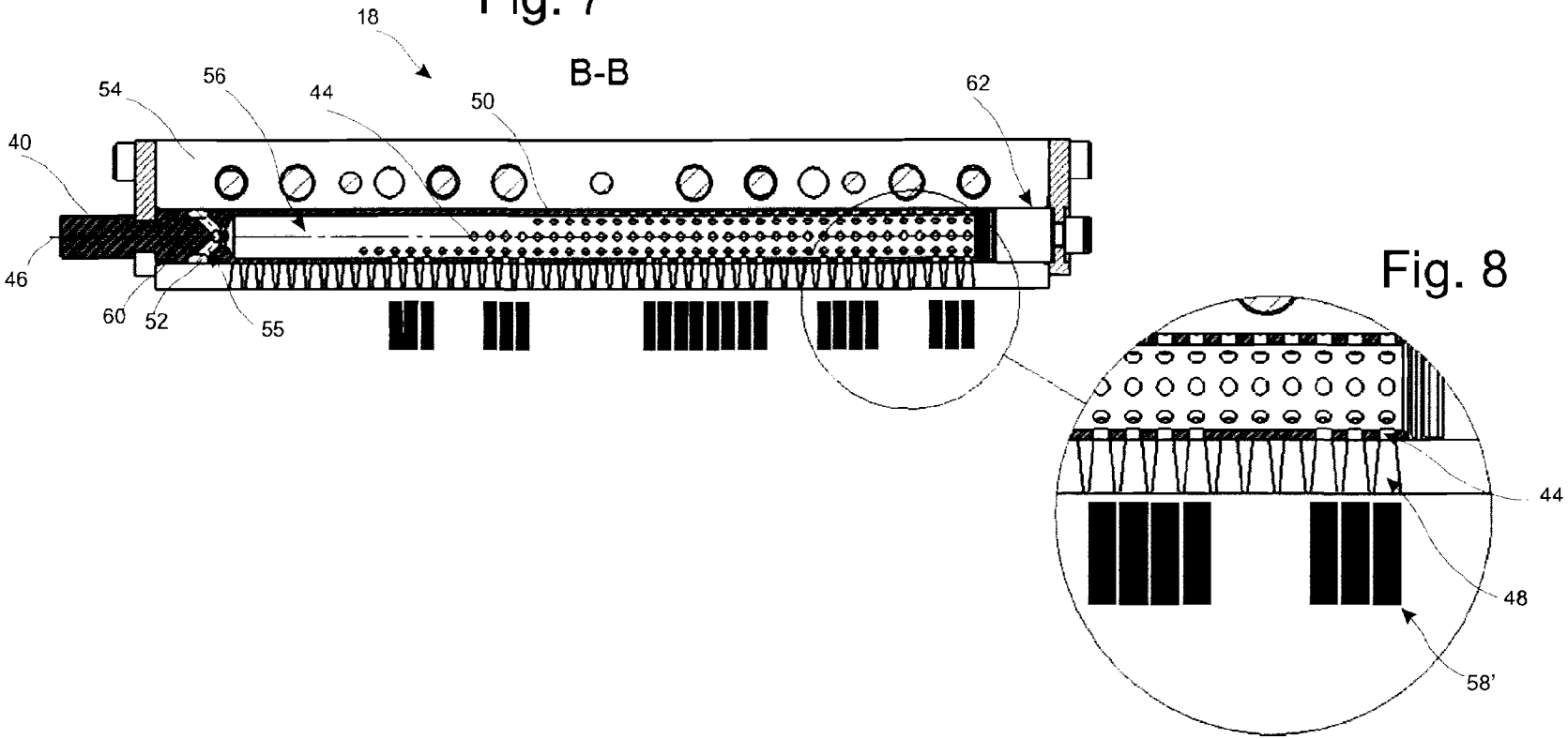
FIG. 7 shows a further cross-sectional view of the nozzle arrangement of FIGS. 3 through 6 with an alternative operating position of the hollow body.
FIG. 8 shows a detail view from the view of FIG. 7.

As shown in FIG. 7 the number and arrangement of the through passages 44 which are aligned with outlet passages 48 can be altered by rotary movement of the hollow body 50. FIG. 7 shows a rotary position of the hollow body 50, that is changed in comparison with FIG. 6, this leading to a modified application pattern 58'. As can be seen in particular from FIG. 8 in the selected rotary position of the hollow body 50 not all outlet passages 48 but only some thereof are communicated with the through passages 44 in such a way that fluid discharge is possible. In this case the configuration of the application pattern 58' primarily depends on the axial arrangement of the through passages 44 at the hollow body 50 in the direction of the longitudinal axis 46 and the number of through passages 44 in a row.

Figure 9:
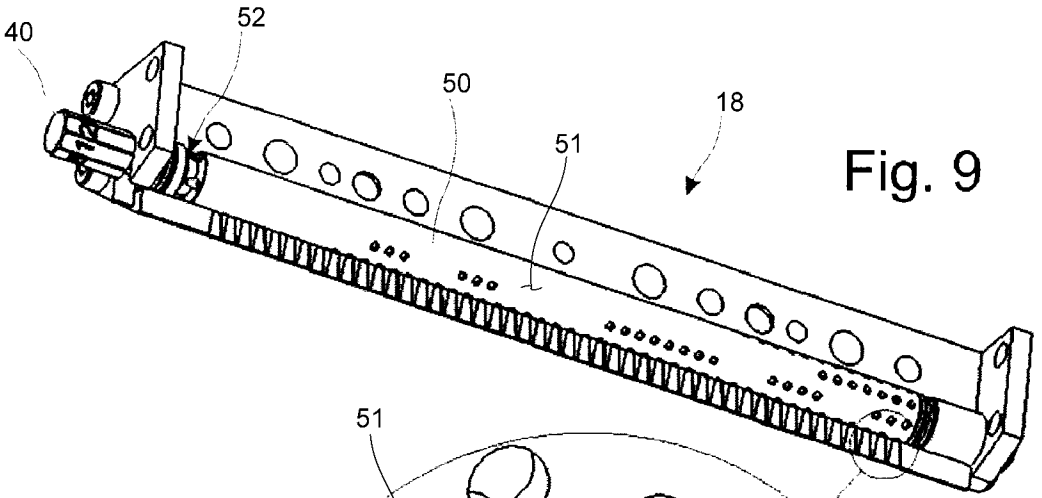
FIG. 9 shows a perspective view of a nozzle arrangement with the mouthpiece removed.
Figure 10:
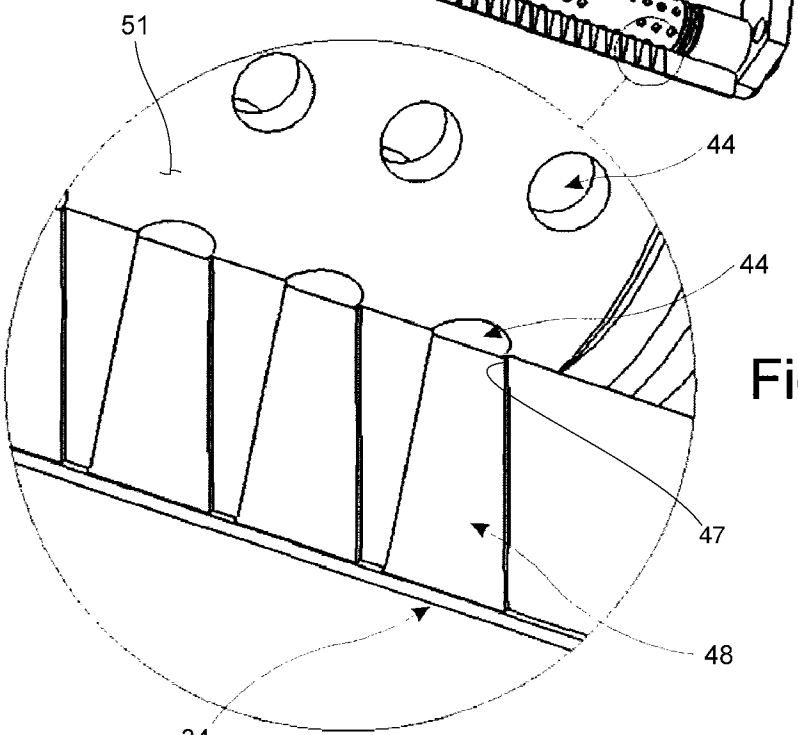
FIG. 10 shows a detail view from the view of FIG. 9.

The view in FIG. 9 with mouthpiece 24 removed gives a three-dimensional view of the shape of the outlet passages 48. It can be seen in particular from FIG. 10 that the outlet passages 48 have an inlet opening 47 which is identical in its width to the diameter of the through passages 44. The width of the outlet passage 48 increases linearly in the direction of flow of the fluid and it opens into the nozzle opening 34. In this case the outlet passages 48 are markedly wider than they are deep and when the mouthpiece 24 is fitted assume a slot-shaped configuration. The exact dimensioning and configuration of the outlet passages 48 can vary according to the respective demand on the application pattern 52. Further influencing variables are the operating parameters of the fluid.

Figure 11:
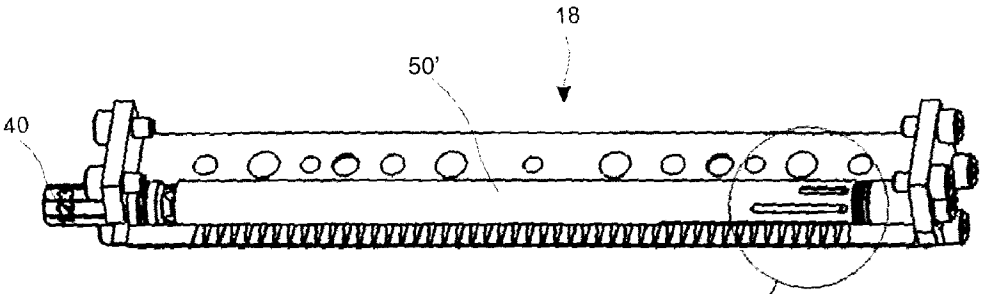
FIG. 11 shows a perspective view of a nozzle arrangement with an alternative hollow body and removed mouthpiece.
Figure 12:
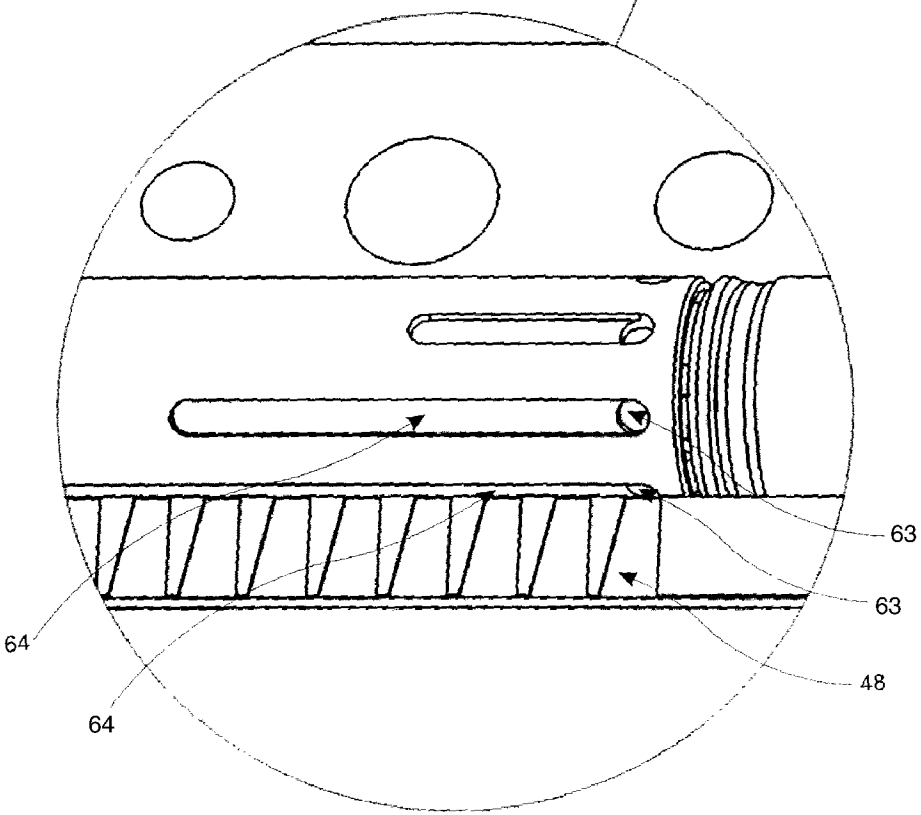
FIG. 12 shows a detail view from the view of FIG. 11.

FIGS. 11 and 12 show an alternative embodiment of a hollow body 50'. As can be seen in particular from FIG. 12 the through passages 44 in this embodiment are not in the form of simple bores but in the form of recesses with a substantially round through hole 63 and a recess 64 in groove shape, extending parallel to the axis 46 (not shown) on the outside surface of the hollow body 50'. In this case the length of the groove 41 determines the number of outlet passages 48 which are supplied with fluid from the distributor passage 41.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features discussed herein may be used alone or in any combination depending on the needs and preferences of the user. This has been a description of illustrative aspects and embodiments the present invention, along with the preferred methods of practicing the present invention as currently known.

What is claimed is:

1. An apparatus for applying fluids such as adhesive, in particular hot melt adhesive, to a substrate movable relative to the apparatus, comprising:

a main body having a feed passage connectable to a fluid source, an application valve for selectively interrupting or enabling the flow of fluid in the feed passage, a nozzle arrangement having a distributor passage connectable to the feed passage, at least one outlet passage communicating with the distributor passage, and at least one nozzle opening communicating with the distributor passage via the at least one outlet passage for delivery of the fluid, and a hollow body which is rotatable in the distributor passage about a longitudinal axis, the hollow body including an outer peripheral surface and a plurality of radially arranged through passages which can be associated with the at least one nozzle opening by rotating the hollow body in such a way that fluid is passed out of the distributor passage into the at least one nozzle opening through at least one through passage and through the at least one outlet passage, the plurality of through passages extending through the outer peripheral surface and being arranged in rows oriented parallel to the longitudinal axis of the hollow body, with each of the rows of through passages respectively including a different number of through passages and/or respectively including a different spacing between the through passages, to modify an application pattern of the fluid by rotating the hollow body to align a different row of through passages with the at least one outlet passage and maintaining the hollow body in that alignment to dispense the modified application pattern, and each of the outlet passages defining an inlet having a width equal to a width of the through passages which can be associated to communicate with that outlet passage.

2. The apparatus as set forth in claim 1, wherein the through passages are respectively mutually spaced along the outer peripheral surface of the hollow body.

3. The apparatus as set forth in claim 1, wherein the rows formed by the through passages are arranged in mutually differing relationship in the hollow body in relation to the longitudinal axis thereof.

4. The apparatus as set forth in claim 1, wherein the through passages have an opening cross-section which is circular, elliptical, oval or polygonal.

5. The apparatus as set forth in claim 1, wherein the hollow body is mounted in the distributor passage rotatably in such a way that in a respective angular position of the hollow body a through passage can be aligned with the at least one nozzle opening.

6. The apparatus as set forth in claim 1, wherein the at least one outlet passage includes an outlet end communicating with the at least one nozzle opening, and the at least one outlet passage is in the form of a recess in the nozzle arrangement, the recess having a slot-shaped or round cross-section.

7. The apparatus as set forth in claim 1, wherein the at least one outlet passage defines a polygonal cross-section.

8. The apparatus as set forth in claim 1, wherein the hollow body can be arrested in a predetermined angular position in force-locking or positively locking relationship with a clamping screw or a latch.

9. The apparatus as set forth in claim 1, further comprising:

a rotary grip which is non-rotatably connected to an end portion of the hollow body and which extends outside the nozzle arrangement.

10. The apparatus as set forth in claim 9, wherein the rotary grip includes a peripheral surface or a peripheral surface composite that is roughened.

11. The apparatus as set forth in claim 1, wherein the nozzle arrangement includes a mouthpiece which is connectable to the nozzle arrangement and can be associated with a portion of the nozzle arrangement to define the at least one nozzle opening.

12. The apparatus as set forth in claim 1, wherein the fluid is fed to the hollow body by a peripherally extending recess which is provided in the outer peripheral surface of the hollow body, wherein at least one conduit extends from the peripherally extending recess into the interior of the hollow body.

13. The apparatus as set forth in claim 1, wherein an outside wall of the hollow body can be brought into substantially sealing contact with a wall of the distributor passage.

14. The apparatus as set forth in claim 7, wherein the at least one outlet passage defines a rectangular or trapezoidal longitudinal cross-section.

15. The apparatus as set forth in claim 1, wherein the plurality of through passages extending through the outer peripheral surface of the hollow body directly communicate with the at least one outlet passage to avoid any flow impairment between the plurality of through passages and the at least one outlet passage when the through passages are aligned with the at least one outlet passage.

* * * * *